US005640814A

United States Patent [19]

Godfrey

[11] Patent Number: 5,640,814

[45] Date of Patent: Jun. 24, 1997

[54] FLOOR FRAME ASSEMBLY FOR A MANUFACTURED HOME

[75] Inventor: Robert E. Godfrey, Bristol, Ind.

[73] Assignee: Schult Homes Corporation, Middlebury, Ind.

[21] Appl. No.: 598,955

[22] Filed: Feb. 9, 1996

[51] Int. Cl.[6] ..... B62D 21/00; E04B 5/00

[52] U.S. Cl. ..... 52/143; 52/79.12; 52/263; 52/653.1; 52/654.1; 52/581; 52/582.1; 280/789

[58] Field of Search ..... 52/143, 79.2, 653.1, 52/299, 690, 648.1, 64, 263, 480, 581, 654.1, 655.1, 126.6, 582.1; 280/789, 799, 795

[56] References Cited

U.S. PATENT DOCUMENTS

| | | | |
|---|---|---|---|
| 2,731,680 | 4/1956 | Bolt | 52/64 |
| 2,985,375 | 5/1961 | Gardner | 280/789 X |
| 3,042,423 | 7/1962 | Bock | 280/789 |
| 3,316,680 | 5/1967 | Chrastek | 52/126.6 |
| 3,425,179 | 2/1969 | Haroldson | 52/263 X |
| 3,606,704 | 9/1971 | Denton | 52/126.6 X |
| 3,830,024 | 8/1974 | Warnke | 52/143 X |
| 4,027,439 | 6/1977 | Willard | 52/299 X |
| 4,232,884 | 11/1980 | DeWitt | 280/789 X |
| 4,517,781 | 5/1985 | LeBlanc | 52/299 |
| 4,630,548 | 12/1986 | Wiger et al. | 52/729.1 X |
| 5,113,625 | 5/1992 | Davis | 52/143 |
| 5,353,558 | 10/1994 | Shea, Sr. et al. | 52/64 X |
| 5,468,008 | 11/1995 | Hecht | 280/789 X |
| 5,474,331 | 12/1995 | Bocher | 280/789 |
| 5,488,809 | 2/1996 | Lindsay | 52/143 X |

*Primary Examiner*—Robert Canfield
*Attorney, Agent, or Firm*—Price, Heneveld, Cooper, DeWitt & Litton

[57] ABSTRACT

A floor frame assembly for modular housing units that includes longitudinally extending floor support beams and transverse supports that are attached to and extend outwardly from an outer one of the longitudinal floor support beams to support an edge portion of the floor assembly. The transverse supports have an outer end substantially less than the height of the end that is secured to the outer beam. A hanger is secured to the outer edge of each of the transverse supports. The height of the hanger is greater than the height of the outer end edge so that a gap is created between the bottom of the outer end and the bottom of the hanger to facilitate the attachment of the hanger to a sill plate of a foundation.

17 Claims, 4 Drawing Sheets

FLOOR FRAME ASSEMBLY FOR A MANUFACTURED HOME

The present invention relates to an improved floor frame assembly for prefabricated manufactured homes.

BACKGROUND OF THE INVENTION

An ever increasing number of prospective home buyers today are choosing factory built manufactured homes over conventional stick-built homes. Today's prefabricated manufactured homes, with their improved construction methods and quality control, can now closely approximate the look and feel of a conventional stick-built home, and can be constructed at a substantial savings compared to a conventional home.

Originally, most prefabricated homes were very similar to the common single width trailer homes, and consequently the living space was long and narrow with rather meager floor space. However, in order to accommodate the wishes of customers who preferred the larger and wider floor space of a traditional home, many of today's manufactured homes are built in modules or sections that are shipped to the home site and joined together on an existing foundation to form a double wide home.

Typically, each half of the home comes equipped complete with exterior and interior walls and flooring, a roof, and many fixtures including the plumbing and appliances. An axle and wheel assembly is attached to each half so that the unit can be separately towed to the home site and joined together over an existing foundation. Accordingly, the floor frame assembly must be strong enough to support the assembled home over a typical foundation, and must also be strong enough to survive the rigors of being shipped from the factory to the home site without excessive flexing, which could damage the superstructure, the interior walls, and the fixtures. Furthermore, the floor frame must be designed so that the two halves can easily be joined together at the home site with a minimum of additional on-site labor.

Floor frame assemblies for shipping manufactured homes are generally well known in the art, although their designs differ greatly. One prior art design is the perimeter frame design, which consists of a rectangular box like frame built from two main longitudinal members that form the outer edges of the frame. The main members are connected by a series of cross members, typically wooden trusses, that span the entire width of the frame. These wooden trusses are very labor intensive and require an extensive amount of bracing and gusset plates in order to make the frame stiff enough to tow, and hence the perimeter frame design is very expensive to produce. Also, the perimeter frame design requires an extensive amount of on site assembly, which increases labor costs and undermines quality control because on site labor is difficult to monitor. One variation of the perimeter frame design consists of simply using floor joists instead of trusses. The floor joists are mounted or "stacked" on top of the main members, and therefore this design requires more vertical space, which means less headroom in the basement, less headroom on the living quarters, or a higher unit that is more expensive and more difficult to transport.

Another prior art design uses two elongated support beams spaced inwardly from the outer edges and are connected by a series of cross members. The cross members are typically made of metal in order to simplify installation and minimize weight, and extend outwardly from the elongated support beams to the edges of the modular unit. However, the design of the outer edge of the outrigger complicates the attachment of a sill plate, and also makes it difficult to attach the ends to an adjacent unit to form a double wide home. Accordingly, this design is more suitable for single width homes. Finally, if the ends of the outriggers are placed directly over the foundation wall, the bottom of the elongated supports hang down into the basement and interrupt the ceiling height in the basement. Accordingly, either the basement needs to be deeper or the builder must add a course of bricks to two sides of the foundation in order to obtain the desired amount of headroom in the basement.

Accordingly, manufacturers of manufactured homes require a floor frame assembly that is easy to manufacture, strong enough to ship to the job site, and strong enough to span fairly large foundations with minimal extra support. Manufacturers of manufactured homes also require an improved floor frame assembly that minimizes the amount of on site labor required, and that can quickly and easily be joined with a like floor frame unit to form a double wide manufactured home.

SUMMARY OF THE INVENTION

The improved floor frame assembly of the present invention is easier and less costly to fabricate than prior art designs, and also is easier and less costly to install at the home site. The present invention also provides a much stiffer floor frame, and therefore the likelihood of damage to the home during shipping is greatly diminished.

The floor frame assembly of the present invention utilizes a longitudinally extending mating beam at the mating edge of the frame which is joined to a similar mating beam on an adjoining frame. Each mating beam is joined to a longitudinally extending support beam by a series of transverse structural cross members, each of which has a vertical web that tapers with distance from the support beam to the mating beam. The resulting gap between the bottom of the cross member and the bottom of the mating beam offers a number of advantages. The gap greatly simplifies the connection of adjacent floor flames to each other over a common support column by providing more room to work, and allows the mating beams to be connected to each other over a support column without having to drill through the bottom flange of the cross member.

The present invention also offers an improved feature along the outer edge of the floor frame, which is the edge of the frame that lies opposite the mating edge. A series of transverse structural cross members extend outwardly from one of the elongated support beams to the outer edge of the floor frame. Again, each of the cross members preferably has a vertical web that tapers with distance from the support beam to the outer edge. A vertical support or hanger is attached to each of the cross members at the outer end, and the height of the hanger is greater than the depth of the vertical web such that a portion of the hanger protrudes below the bottom of the web, defining a gap between the bottom of the cross member and the bottom of the hanger. Once again, a gap is defined between the protruding portion of the hanger and the bottom edge of the cross member, which offers a number of distinct functional advantages. The hanger stiffens the outer edge of the cross members and hence stiffens the entire floor frame. Also, the protruding portion greatly simplifies the attachment of the sill plate to the floor frame, which speeds assembly and eases final installation.

Accordingly, it is an object of this invention to provide an improved floor frame assembly for manufactured homes that is easier to fabricate.

It is another object of this invention to provide an improved floor frame assembly that is stronger and stiffer than prior art frames so that the likelihood of damage to the home during transit and installation is minimized.

A further object of this invention is to provide a floor frame assembly for manufactured homes that is easier to assemble, requires less on site labor, and that provides more uniform quality.

Other objects of the invention will become readily apparent to those skilled in the art upon a reading of the following description.

DESCRIPTION OF THE PREFERRED EMBODIMENT

Figure 1:
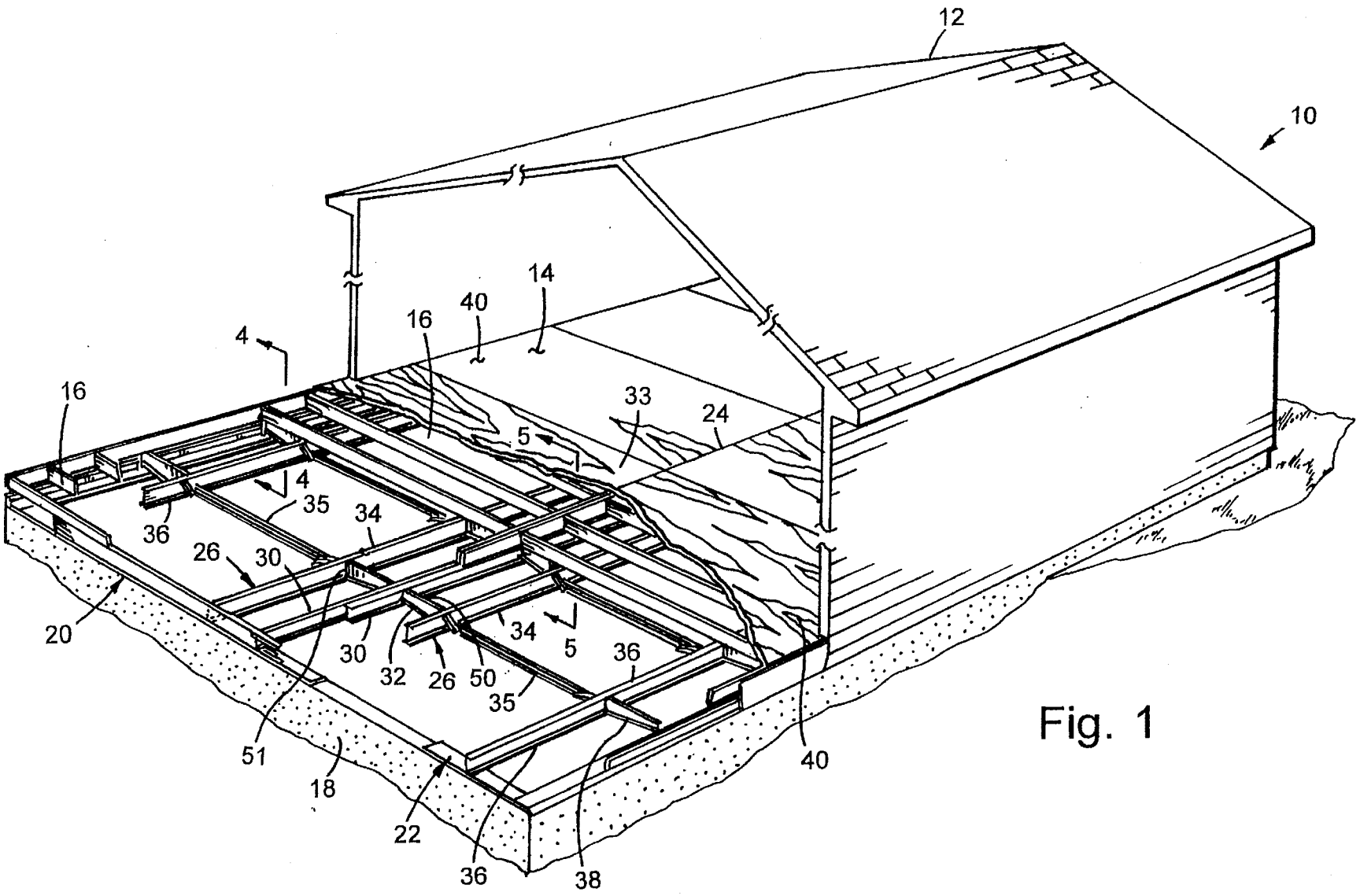
FIG. 1 is a perspective view of the floor frame assembly of the present invention shown attached to a compatible unit to form a unified structure placed over a foundation, having the superstructure and the floor structure partially cut away.

The preferred embodiment herein described is not intended to be exhaustive or to limit the invention to the precise form disclosed. It is chosen and described to explain the principles of the invention and its application and practical use to best enable others skilled in the art to follow its teachings.

Referring now to the drawings, a modular housing unit assembled according to the present invention is generally referred to by the reference numeral 10, and includes a conventional superstructure 12 enclosing a conventional wooden floor 14 supported by a number of floor joists 16, all of which is placed on a foundation 18 of poured concrete, concrete block, or other conventional construction. The housing unit 10 is formed from two halves 20, 22 which are joined along mating line 24. Each half includes a floor support frame 26 that includes a number of elongated floor support beams 30, 34, and 36. One beam 30 extends along the mating line 24 and is joined to the corresponding beam from the neighboring half. The connection 31 between beam 30 and the corresponding beam from the neighboring unit is discussed in greater detail below. A plurality of transverse supports 32 connect beam 30 to an adjacent beam 34 to support the central portion 33 of floor 14. In a similar fashion, a plurality of cantilevers or transverse edge supports 38 extend outwardly from outer beam 36 to support the edge portion 40 of the floor 14. Outer beam 36 is connected at intervals to adjacent beam 34 by a plurality of stringers or braces 35.

Figure 2:
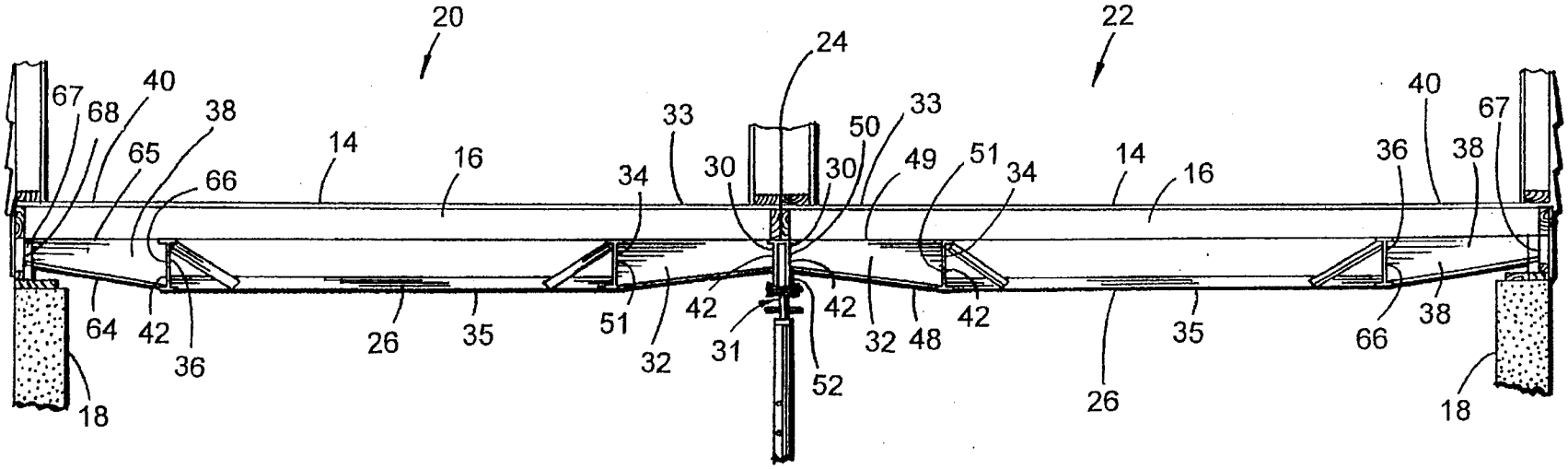
FIG. 2 is a cross-sectional view of the floor frame assembly shown in FIG. 1, again showing the frame of the present invention attached to a compatible unit.
Figure 3:
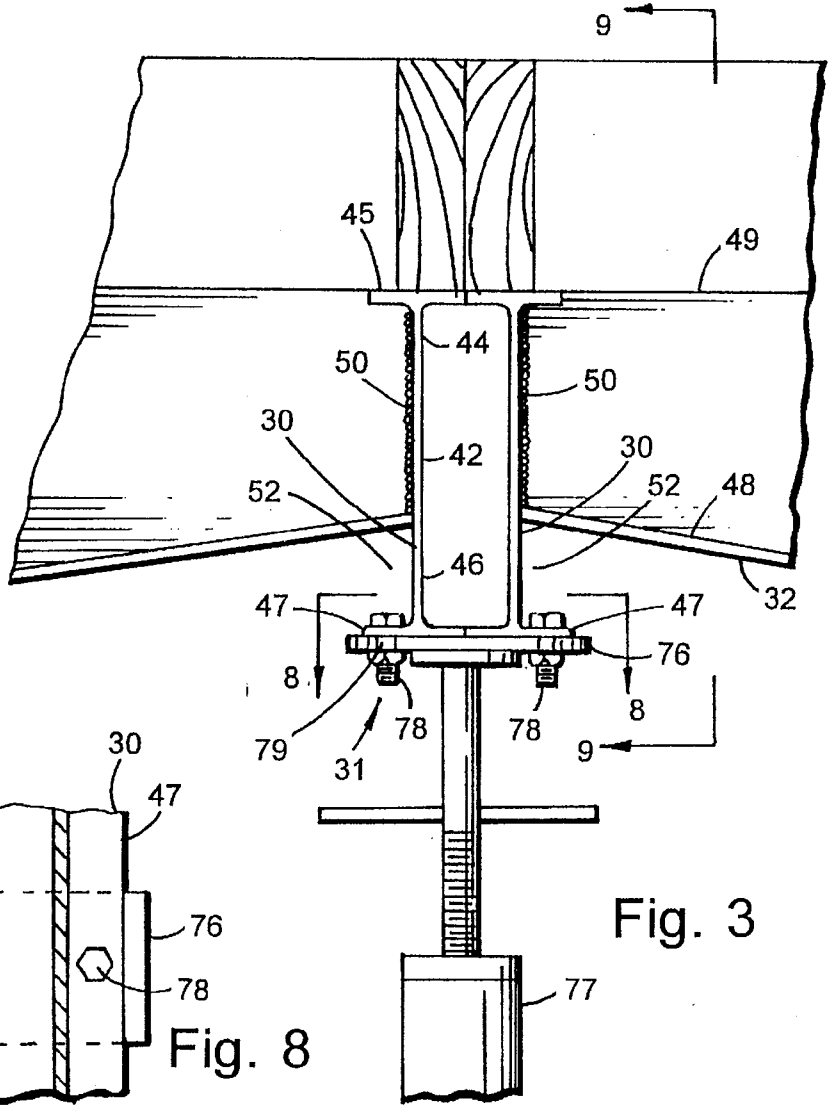
FIG. 3 is a fragmentary cross-sectional view of the connection along the mating line between two compatible units.

As shown in FIGS. 2 and 3, beams 30, 34, and 36 each include a generally vertical web 42, an upper portion 44 that terminates in a generally horizontal top flange 45, and a lower or bottom portion 46 that terminates in a generally horizontal bottom flange 47. Transverse supports 32 include a lower edge 48 and an upper edge 49, and a pair of substantially vertical joining edges 50, 51, connected to the webs 42 of beam 30 and beam 34, respectively. The vertical length of joining edge 50 is substantially less than the height of web 42 of beam 30 such that the bottom portion 46 of beam 30 is exposed, thereby creating a gap 52 between the lower edge 48 of transverse support 32 and the lower portion 46 of beam 30.

Figure 9:
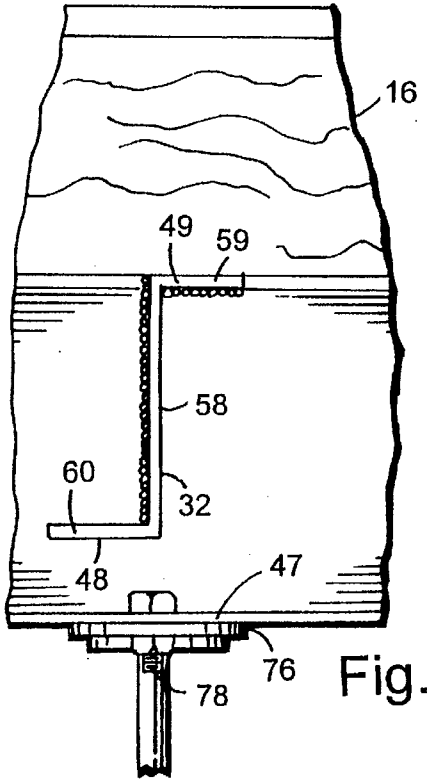
FIG. 9 is a fragmentary sectional view taken along line 9—9 of FIG. 3.
Figure 5:
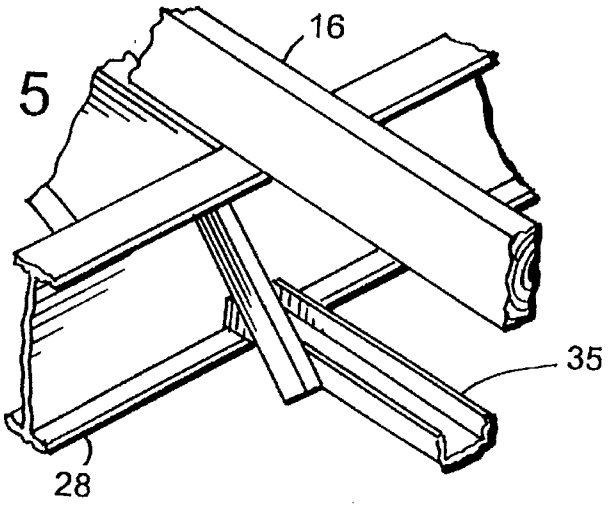
FIG. 5 is a fragmentary view in perspective of the bracing connected to one of the beams taken along lines 5—5 of FIG. 1.
Figure 6:
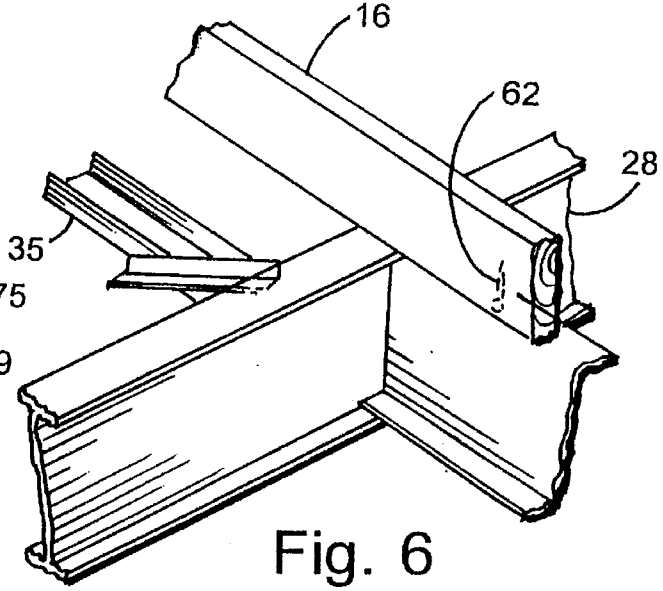
FIG. 6 is a fragmentary view in perspective of the connection between one of the transverse supports and one of the beams.

As shown in FIG. 9, the cross section of transverse supports 32 preferably include a vertical central portion 58 and upper and lower oppositely extending horizontal legs or portions 59, 60, respectively. The upper horizontal portion 59 substantially forms the upper edge 49, while the bottom horizontal portion 60 substantially forms the lower edge 48 of transverse supports 32. Floor joist 16 overlies transverse support 32, and floor joist 16 is connected at intervals to the upper horizontal portion 59 of transverse support 32 by lag bolts 62 as shown in FIGS. 4 and 6 or similar conventional means.

Figure 7:
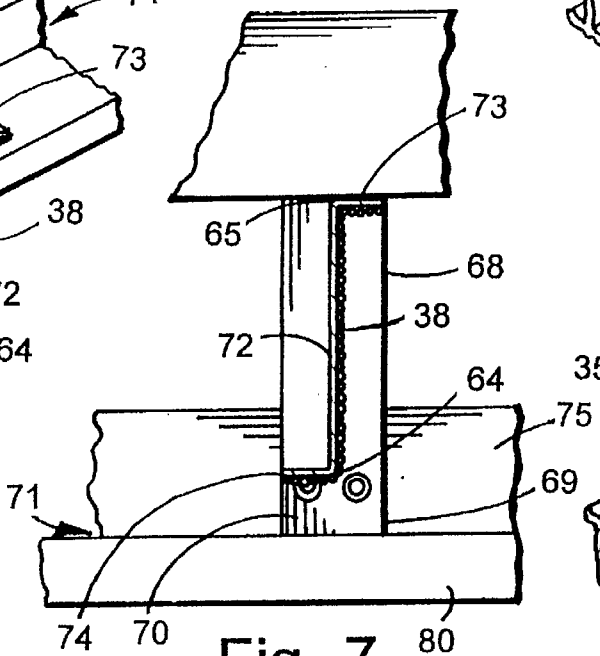
FIG. 7 is a fragmentary sectional view taken along lines 7—7 of FIG. 4.
Figure 4:
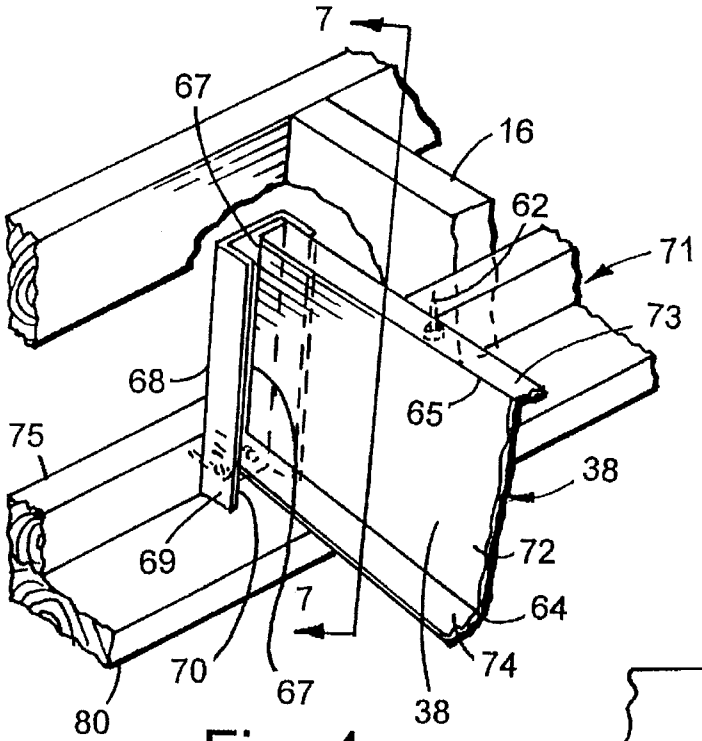
FIG. 4 is a fragmentary view in perspective of the edge portion of the floor structure taken along lines 4—4 of FIG. 1 illustrating the channel hanger at the outer end of the transverse supports.

As shown in FIGS. 2, 4, and 7, transverse edge supports 38 include a lower edge 64 and an upper edge 65, and pair of substantially vertical joining edges 66, 67. Vertical joining edge 66 is attached to the web 42 of outer beam 36, while joining edge 67 overlies foundation 18. A substantially vertical post or hanger 68 is attached to joining edge 67, and the vertical length of joining edge 67 is substantially less than the height of hanger 68 such that the bottom portion 69 of hanger 68 is exposed, thereby creating a gap 70 between the lower edge 64 of transverse support 38 and the bottom portion 69 of hanger 68. A sill plate assembly 71 is attached to the bottom portion 69 of hanger 68 by bolts or other conventional means. Sill plate assembly 71 includes upper and lower portions 75, 80, and the sill plate assembly 71 is substantially continuous along the perimeter of each half 20, 22. Upper portion 75 is attached to the bottom portion 69 of hanger 68, and the lower portion 80 is in turn attached to the upper portion by nails or other conventional fasteners (not shown). The lower portion 80 supports the edge portion 40 of the floor 14 on the foundation 18, and helps to spread the load from hanger 68.

As shown in FIGS. 4 and 7, the cross section of transverse edge support 38 preferably includes a vertical central portion 72 and upper and lower oppositely extending horizontal legs or portions 73, 74, respectively. The upper horizontal portion 73 substantially forms the upper edge 65, while the bottom horizontal portion 74 substantially forms the lower edge 64 of transverse edge supports 38. Floor joist 16 overlies transverse edge support 32, and is connected at intervals to the upper horizontal portion 74 of transverse edge support 38 by lag bolts 62 or similar conventional means.

Figure 8:
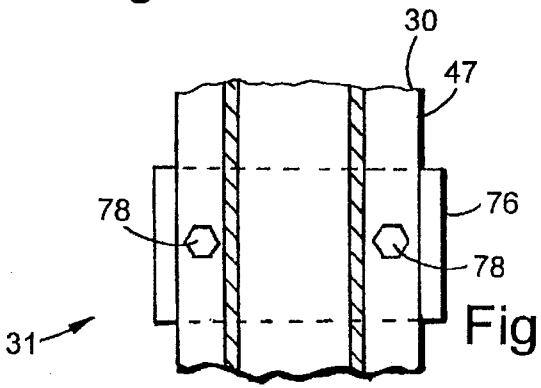
FIG. 8 is a fragmentary sectional view taken along line 8—8 of FIG. 3, with the fasteners removed for clarity.

FIGS. 3 and 8 illustrate the connection 31 between beam 30 and the corresponding beam from the neighboring unit. Connection 31 includes a plate 76 that spans the bottom flange 47 of beam 30 and the bottom flange 47 of the neighboring beam. The plate 76 permits both beams to be supported over a common means of support, such as a conventional jack post or column 77. Two or more bolts, rivets, or other conventional fasteners 78 through holes 79 connect the bottom flange 47 from beam 30 to the neighboring beam.

In operation, each half 20, 22 of housing unit 10 is constructed at the factory over frame 26, and each half preferably includes approximately half of the superstructure 12 and floor 14, as well as half of the sill plate assembly 71. One or more axles (not shown) is attached to each half, which enables each half to be separately towed to a home site. Each frame 26 is placed on the foundation so that the sill plate assembly 71 is supported on foundation 18 and so that the edges of each frame lie adjacent each other along mating line 24. One or more columns is positioned below beam 30, and connection 31 is completed by fastening plate 76 to the bottom flange of beam 30 and to the bottom flange of the neighboring beam. The gap 52 between the lower edge 48 of transverse support 32 and the bottom flange 47 of beam 30 facilitates easy access to the fasteners 78 used in connection 31, so that the connection can be completed easily. On the outside edges of the modular unit, the sill plate assembly is tied down to the foundation 18 by a number of tie down straps (not shown) as is common in the industry, and the roof, walls, and floor along mating line 24 are finished to form a single modular unit 10. Finally, the axles (not shown) preferably are removed so that they do not interrupt the headroom in the basement or crawl space.

It is understood that the above description does not limit the invention to the above-given details, but may be modified within the scope of the following claims.

What is claimed:

1. A towable floor frame assembly for a modular housing unit comprising multiple longitudinally extending floor support beams, one of said beams extending along a mating edge of said assembly for mating with a corresponding beam of a compatible unit to form a floor support structure, said one beam including a bottom portion, each of said beams including a generally vertically extending web, and transverse supports extending between said one beam and an adjacent beam, each of said transverse supports including a lower edge and an upper edge extending between said beams, the height of said transverse supports being continually tapered between said one beam and said adjacent beam, and a pair of substantially vertical joining ends extending between said upper and lower edges and being secured to the webs of said one beam and the adjoining beam respectively, the length of the joining ends secured to said one beam being greater than one half the height of the web of said one beam and less than the height of the web of said one beam whereby an exposed portion of said web of the one beam extends below said lower edge of each said transverse supports, said lower edge of each transverse support cooperating with the bottom portion of said one beam to define a gap therebetween.

2. The assembly as claimed in claim 1, including a corresponding beam and a connection between said one beam and said corresponding beam, said connection including a plate attached to said bottom portion of said one beam and a bottom portion of said corresponding beam, respectively.

3. The assembly as claimed in claim 2, wherein each of said beams includes generally horizontal top and bottom flanges, said bottom flange substantially defining said bottom portion of said one beam.

4. The assembly as claimed in claim 1, wherein each of said transverse supports has a substantially vertical central portion and further has upper and lower oppositely extending horizontal legs, whereby said upper and lower horizontal legs substantially define said upper and lower edges, respectively, of said transverse supports.

5. The assembly as claimed in claim 4, wherein said upper horizontal leg of said transverse supports define a support surface for supporting a floor joist thereon, said floor joist being affixed at intervals to said upper horizontal leg by fasteners.

6. A towable floor frame assembly for a modular housing unit comprising multiple longitudinally extending floor support beams, one of said beams extending along a mating edge of said assembly for mating with a corresponding beam of a compatible unit to form a floor support structure, said one beam including a bottom portion, each of said beams including a generally vertically extending web;

transverse supports extending between said one beam and an adjacent beam, each of said transverse supports including a lower edge and an upper edge extending between said beams, and a pair of substantially vertical joining ends extending between said upper and lower edges and being secured to the webs of said one beam and the adjoining beam respectively, the length of the joining ends secured to said one beam being less than the height of the web of said one beam whereby an exposed portion of said web of the one beam extends below said lower edge of each said transverse supports, said lower edge of each transverse support cooperating with the bottom portion of said one beam to define a gap therebetween; and an edge portion extending from an outer support beam, transverse edge supports mounted on said outer beam and extending therefrom to support said edge portion, said transverse edge supports having a pair of end edges, one of said end edges of each said transverse edge supports being secured to said outer support beam, the other end edge of each said transverse edge support having a length less than the length of said one end edge, each of said transverse edge supports including upper and lower joining legs extending between the end edges, and a hanger secured to said other end of each of said transverse edge supports, said hanger being longer than said other end edge whereby a projecting portion of the hanger extends below said other end edge to engage a sill plate for supporting said hanger and said transverse edge supports on a foundation, said lower joining leg cooperating with said projecting portion of said hanger to define a gap therebetween.

7. Towable floor frame assembly for a modular housing unit comprising multiple longitudinally extending floor support beams, one of said beams extending along a mating edge of said assembly for mating with a corresponding beam of a compatible unit to form a floor support structure, said one beam including a bottom portion, a corresponding beam and a connection between said one beam and said corresponding beam, said connection including a plate attached to said bottom portion of said one beam and a bottom portion of said corresponding beam, respectively, each of said beams including a generally vertically extending web, and transverse supports extending between said one beam and an adjacent beam, each of said transverse supports including a lower edge and an upper edge extending between said beams, and a pair of substantially vertical joining ends extending between said upper and lower edges and being secured to the webs of said one beam and the adjoining beam respectively, the length of the joining ends secured to said one beam being less than the height of the web of said one beam whereby an exposed portion of said web of the one beam extends below said lower edge of each said transverse supports, said lower edge of each transverse support cooperating with said bottom portion of said one beam to define a gap therebetween, wherein each of said beams includes generally horizontal top and bottom flanges, said bottom flange substantially defining said bottom portion of said one beam, and wherein said plate includes a plurality of holes for alignment with corresponding holes in said bottom flanges of said one beam and said corresponding beam respectively, and fasteners positioned in said holes for securing said plate to said flanges.

8. Towable floor frame assembly for a modular housing unit comprising:

multiple longitudinally extending floor support beams for supporting a floor structure, said floor structure having an edge portion extending from an outer support beam;

a plurality of spaced support members coupling said longitudinally extending floor support beams;

transverse edge supports mounted on said outer beam and extending therefrom to support said edge portion, said transverse edge supports having a pair of end edges, one of said end edges of each said transverse edge supports being secured to said outer support beam, the other end edge of each said transverse edge support having a length less than the length of said one end edge, each of said transverse edge supports including upper and lower joining legs extending between the end edges; and a hanger secured to said other end of each of said transverse edge supports, said hanger being longer than said other end edge whereby a projecting portion of the hanger extends below said other end edge to engage a sill plate for supporting said hanger and said transverse edge supports on a foundation, said lower joining leg cooperating with said projecting portion of said hanger to define a gap therebetween.

9. The assembly as claimed in claim 8, wherein said projecting portion of said hanger provides an attachment surface for attaching a sill plate to said hanger.

10. The assembly as claimed in claim 9, wherein said gap provides access to said projecting portion of said hanger from underneath said transverse supports.

11. The assembly as claimed in claim 8, wherein the cross section of said transverse edge supports has a substantially vertical central portion.

12. The assembly as claimed in claim 11, wherein said upper joining leg defines a support surface for supporting a floor joist thereon, said floor joist being affixed at intervals to said upper joining leg by fasteners.

13. The assembly as claimed in claim 11, wherein each of said hangers includes a connecting portion and a pair of leg portions extending from said connecting portion.

14. A floor support system for a manufactured home comprising:

a plurality of longitudinally extending I-beams extending in substantially parallel spaced relationship; and a plurality of transverse beams extending orthogonally to said longitudinal beams, each having one end and an opposite end coupled to adjacent longitudinal beams, respectively, and at least some of said transverse beams being continually tapered in height such that said one end is substantially the same height as an adjoining longitudinal beam and said opposite end has a height greater than about one-half the height of an adjoining longitudinal beam and less than the height of said longitudinal beam.

15. The floor support as defined in claim 14 wherein said opposite end of each of said transverse beams define a vertical gap between said opposite end of said transverse beam and said adjoining longitudinal beam.

16. The floor support as defined in claim 14 and further including a plurality of additional transverse beams, each having a first end coupled to and extending outwardly from an outer one of said longitudinal I-beams, each of said additional transverse beams tapered in height with said first end having a height substantially the same as said outer one of said longitudinal I-beams.

17. The floor support as defined in claim 16 and further including a hanger coupled to said opposite end of each of said additional transverse beams.

* * * * *